US005352373A

United States Patent [19]

Goto

[11] Patent Number: 5,352,373

[45] Date of Patent: Oct. 4, 1994

[54] LUBRICATING COMPOSITION FOR USE IN HOT ROLLING OF STEELS

[75] Inventor: Kunio Goto, Takarazuka, Japan

[73] Assignee: Sumitomo Metal Industries, Ltd., Osaka, Japan

[21] Appl. No.: 26,786

[22] Filed: Mar. 5, 1993

[30] Foreign Application Priority Data

| | | | |
|---|---|---|---|
| Mar. 5, 1992 | [JP] | Japan | 4-048568 |
| Jun. 16, 1992 | [JP] | Japan | 4-156827 |
| Sep. 1, 1992 | [JP] | Japan | 4-233268 |
| Oct. 14, 1992 | [JP] | Japan | 4-276249 |

[51] Int. Cl.[5] ..... C10M 125/22

[52] U.S. Cl. ..... 252/18; 252/33; 72/236

[58] Field of Search ..... 252/18, 33; 72/236

[56] References Cited

U.S. PATENT DOCUMENTS

| | | | |
|---|---|---|---|
| 3,429,811 | 2/1969 | Robbins et al. | 252/18 |
| 3,776,847 | 12/1973 | Pearson et al. | 252/33 |

*Primary Examiner*—John Niebling
*Assistant Examiner*—Edna Wong
*Attorney, Agent, or Firm*—Burns, Doane, Swecker & Mathis

[57] ABSTRACT

A lubricating composition for use in hot rolling comprises from about 20% to about 70% by weight, based on the total weight of the composition, of an overbased metal sulfonate, e.g., overbased calcium sulfonate, having a base number of at least about 40 mg-KOH/g and preferably at least 200 mg-KOH/g. The lubricating composition can be applied to at least one pair of work rolls in a rolling mill during hot rolling of a steel. It may also be applied to the steel itself immediately before hot rolling. The lubricating composition is effective for preventing galling and reducing roll wear without causing slippage of the steel and it is particularly suitable for use in hot rolling of carbon steel under severe conditions or of stainless steel including high-Cr stainless steel.

15 Claims, 2 Drawing Sheets

LUBRICATING COMPOSITION FOR USE IN HOT ROLLING OF STEELS

BACKGROUND OF THE INVENTION

The present invention relates to a lubricating composition for use in hot rolling of various steels including carbon steels and stainless steels. More particularly, it pertains to a lubricating composition which can exert lubricating properties, such as prevention of galling and reduction of roll wear, not only in sheet rolling but also in caliber rolling into shapes, rods, and tubes. The lubricating composition of the present invention has very high lubricity and is particularly suitable for use in hot rolling of stainless steels which are highly susceptible to galling. The present invention also relates to a lubricating method using such a composition.

The corrosion resistance of steels can be drastically improved by addition of a relatively large amount of chromium. High-Cr steels, typical of which are stainless steels, contain 13% by weight or more of chromium and form a stable chromium oxide protective film on the steel surface, thereby passivating the surface and improving the corrosion resistance. However, the surface oxide film is much thinner than that formed on the surface of carbon steels and is readily removed upon plastic deformation during hot rolling.

Also, in hot rolling of carbon steels under a high load, e.g., hot rolling at a relatively low temperature or a high reduction ratio, the surface oxide film does not sufficiently protect the steel surface or it is readily removed upon severe plastic working.

Hot rolling of a steel under these circumstances often causes seizing of the steel on the work rolls, resulting in a roughening of the surfaces of the work rolls, which, in turn, leads to the formation of surface flaws (hereinafter referred to as "seizure flaws") on the hot-rolled product. In addition, the work rolls wear so rapidly that the pass schedule may be limited.

The fragments of oxide film removed from the steel may remain on the steel surface as hard foreign matter, which is introduced into the roll gaps in subsequent or downstream mill stands and may cause the formation of surface flaws (hereinafter referred to as "scale flaws") on both the rolls and the hot-rolled product.

The formation of these surface flaws, which is generally called galling, is a serious problem in hot rolling. Any appreciable surface flaws must be removed by dressing the hot-rolled product by means of grinding, for example, or if the flaws are severe, the hot-rolled products have to be scrapped.

In order to cope with this problem, a lubricant is usually applied to the work rolls or their backup rolls in order to reduce the friction between the work rolls and the steel, thereby preventing seizure and hence minimizing surface roughening and wear of the rolls and improving the quality of the hot-rolled product.

One such lubricant proposed in Japanese Unexamined Patent Application Kokai No. 47-18907(1972) is a lubricating composition which comprises a natural fatty acid, a minor amount (0.1% -10% by weight) of a water displacing agent, and optionally a mineral lubricant oil. The water displacing agent used in the composition is preferably an oil-soluble sulfonate salt such as a metal petroleum sulfonate.

Japanese Patent Publications Nos. 62-14598(1987), 62-39198(1987), and 62-39199(1987) describe lubricating compositions comprising finely divided calcium carbonate of 10 μm or less in size dispersed in water or a lubricant base oil.

However, these lubricating compositions are designed to be used in hot rolling of carbon steels under normal conditions and cannot prevent stainless steels from galling during hot rolling. Therefore, surface flaws are formed on the hot-rolled stainless steels and the work rolls used in the hot rolling wear rapidly Lubricating compositions which have been proposed for use in hot rolling of stainless steels comprise an iron oxide powder dispersed in a lubricating oil, as described in Japanese Unexamined Patent Application Kokai No. 63-254195(1988), or a graphite powder dispersed in a viscous aqueous solution, as described in Japanese Unexamined Patent Application No. 1-167396(1989). The use of an iron oxide powder, however, does not adequately prevent galling or greatly reduce roll wear during hot rolling of stainless steels. Graphite brings about an extreme decrease in the coefficient of friction and may cause the stainless steels to slip or fail to smoothly insert into the roll gap with tight engagement. Therefore, graphite cannot be used in an amount sufficient to completely prevent the rolls from galling and significantly reduce the roll wear.

These prior-art lubricating compositions are mainly intended to prevent the formation of seizure flaws. No effective measures have been established with respect to prevention of scale flaws caused by foreign matter and dirt remaining on the steels to be hot rolled.

SUMMARY OF THE INVENTION

It is an object of this invention to provide a lubricating composition and a lubricating method for hot rolling which can effectively prevent surface flaws (both seizure flaws and scale flaws) during hot rolling of various steels including stainless steels, thereby making it possible to produce clean, high quality hot-rolled products which are free from surface flaws while significantly retarding roll wear.

Another object of the present invention is to provide a lubricating composition and a lubricating method for hot rolling which enable hot rolling of steels, particularly stainless steels, to be performed with improved operating efficiency without problems such as failure of the steel to engage with a roll gap or slippage of the steel.

It has been found that the above objects can be achieved by a lubricating composition based on an overbased metal sulfonate. The overbased metal sulfonate is known as a detergent-dispersant and is normally added to a lubricating oil in a small amount. There have been no attempts to use the overbased metal sulfonate as a main lubricant component of a lubricating composition.

The present invention provides a lubricating composition for use in hot rolling of steels, which comprises from about 20% to about 70% by weight, based on the total weight of the composition, of an overbased metal sulfonate having a base number of at least about 40 mg-KOH/g in which the metal is one or more alkaline earth metals.

Preferably the metal is selected from calcium, barium, and magnesium and most preferably it is calcium.

The lubricating composition can be applied to at least one pair of work rolls during hot rolling either directly or through their backup rolls. Alternatively, it may be applied to both the work rolls and the steel to be rolled.

The base number of the overbased metal sulfonate is determined by a potentiometric titration method as defined in JIS K2501. When the overbased metal sulfonate is a mixture of two or more of these salts, e.g., a mixture of calcium sulfonate and magnesium sulfonate, the weighted average value of the base numbers of the respective salts should be at least about 40 mg-KOH/g.

DESCRIPTION OF THE INVENTION

Figure 1:
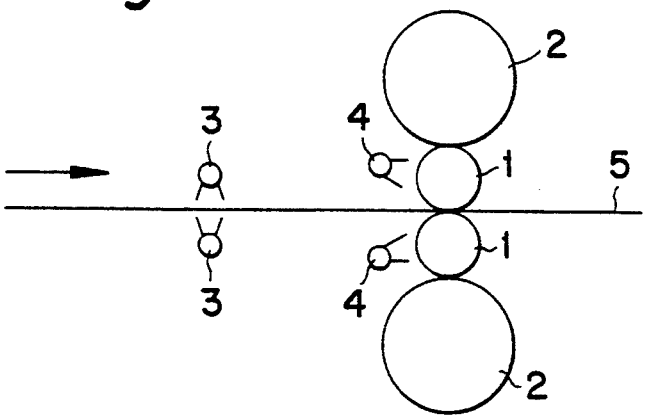
FIGS. 1 to 5 are schematic illustrations showing various lubricating methods.

The lubricating composition of the present invention comprises from 20% to 70% by weight, based on the total weight of the composition, of an overbased metal sulfonate (where the metal is an alkaline earth metal such as Ca, Ba, or Mg or a mixture of alkaline earth metals) in a base oil.

The overbased metal sulfonate, e.g., overbased Ca sulfonate, can be prepared by reacting a metal sulfonate (normal salt) with an alkaline earth metal oxide or hydroxide, e.g., CaO or $Ca(OH)_2$, in the presence of carbon dioxide gas. The normal metal sulfonate salt, e.g., Ca sulfonate, can be obtained by neutralization of an oleophilic petroleum sulfonic acid (which is prepared by sulfonating an alkyl aromatic with fuming sulfuric acid or $SO_3$ gas) so as to form the corresponding alkaline earth salt, e.g., Ca salt.

The alkyl aromatic used as a starting material in the preparation of the overbased metal sulfonate may be either a lubricating oil fraction of mineral oil or a synthetic substance such as an alkylbenzene, a reaction product obtained by alkylation of benzene with a polyolefin, or dinonylnaphthalene.

The overbased metal sulfonate contains an excess of an alkaline earth metal, e.g., Ca, and its alkaline earth metal content is from about 3 times to about 15 times that of the corresponding normal metal sulfonate salt. The excess alkaline earth metal is primarily present in the form of its carbonate, e.g., $CaCO_3$, forming colloidal particles having a particle diameter of about 150 angstrom or smaller which are dispersed in the base oil.

It has been found that an overbased metal sulfonate salt exhibits excellent lubricating properties such that it can be used as a main lubricant component. The excellent lubricating properties of the salt are thought to result from its good heat resistance whereby it is not decomposed or burnt out completely in the temperature range at which steel is hot rolled, and it exists as a fluid or semi-fluid in that temperature range, thereby contributing to lubrication. Furthermore, the overbased metal sulfonate salt can react with or adsorb the metal or oxide present on the steel surface so as to form a lubricating film on the surface. The lubricating film formed from the salt inhibits direct metal/metal contact at the working interface between one of the work rolls and the steel to be rolled, thereby effectively preventing galling and minimizing roll wear.

As described above, the overbased metal sulfonate salt contains fine particles (less than about 150 angstrom) of a metal carbonate such as $CaCO_3$, $BaCO_3$, or $MgCO_3$ precipitated spontaneously in the preparation stage of the salt. When the salt is mixed with a base lubricating oil, the fine particles form a colloidal dispersion in the oil which liberates the corresponding oxide (CaO, BaO, or MgO) in the hot-rolling temperature range.

The fine particles of the metal carbonate or the metal oxide liberated from the carbonate possess no lubricating activity but they function as a carrier to carry the sulfonate salt to the working interface between one the work rolls and the steel, thereby facilitating the lubricating activity of the sulfonate salt. As a result, the overbased sulfonate salt is introduced into the working interface in a uniform and stable manner.

Thus, the overbased metal sulfonate can effectively prevent galling and reduce roll wear by a synergistic effect of the lubricating properties of the metal sulfonate itself and the function as a carrier of the precipitated metal carbonate fine particles having a particle size on the order of 150 angstrom or smaller.

This is in contrast with the prior art carbonate-containing lubricating composition described in Japanese Patent Publications Nos. 62-14598(1987), 62-39198(1987), and 62-39199(1987) in which a fine powder of calcium carbonate having a particle size of 1 to 10μm (=10,000 to 100,000 angstrom) is directly dispersed in a base lubricating oil. In this case, the carbonate powder is said to enhance a lubricating activity by itself.

When the lubricity attained by the overbased metal sulfonate is so high that the friction at the working interface is so excessively decreased that the steel cannot smoothly insert into the roll gap at the beginning of hot rolling or slippage of the steel occurs during hot rolling, the metal carbonate particles precipitated in the overbased metal sulfonate may be grown to a coarser particle size, such as in the range of from about 150 to about 5,000 angstrom and preferably from about 150 to about 500 angstrom. The growth of the carbonate particles can be achieved by adding a polar substance such as water or methanol as a nucleating agent. The growth is effective for preventing the above-described slippage or failure of engagement without significantly decreasing the lubricity.

The overbased metal sulfonate has strong detergent and dispersing properties since it was originally developed as a detergent-dispersant. Therefore, it can remove foreign matter remaining on the steel surface after hot rolling such as fragments of oxide film removed from the steel and metal powder resulting from roll wear. Hence, it can effectively prevent the formation of scale flaws caused by such foreign matters.

Due to the above-described properties of the overbased metal sulfonate, the lubricating composition of the present invention prevents the steel from seizing to the work rolls during hot rolling while minimizing roll wear, and at the same time it minimizes the amount of foreign matter such as fragments of oxide film remaining on the surface of the hot-rolled steel. Consequently, the hot-rolled steel product can be effectively protected against both seizure flaws and scale flaws so that it is guaranteed to have good quality.

The overbased metal sulfonate is present in the lubricating composition in a proportion of from about 20% to about 70% by weight based on the total weight of the composition. When the proportion is less than about 20%, the resulting composition cannot adequately perform the desired lubricating activities. A lubricating composition containing more than about 70% of the metal sulfonate is so viscous that it is difficult to apply. Preferably, the proportion of the overbased metal sulfonate is between about 30% and about 60%.

In general, a Ca sulfonate has the highest lubricity among the alkaline earth salts of the sulfonic acid having the same base number. Therefore, when the steel to be rolled is particularly susceptible to galling, as is the case with stainless steels, or when the load applied by hot rolling is particularly heavy, it is preferred that an overbased Ca sulfonate constitute at least part of the metal sulfonate and more preferably the entire part thereof.

The base number of the overbased metal sulfonate should be at least about 40 mg-KOH/g. A based metal sulfonate having a base number lower than about 40 mg-KOH/g cannot exert a lubricating effect required for hot rolling. The lubricity of a metal sulfonate increases with an increase in the base number.

Preferably, the overbased metal sulfonate used in the lubricating composition has a base number in the range between about 200 and about 500 mg-KOH/g. An overbased metal sulfonate having a base number of about 200 mg-KOH/g or higher is preferred since its lubricity is particularly improved with respect to both prevention of galling and reduction in roll wear. There is no particular maximum value for the base number of the sulfonate, but an overbased metal sulfonate having a base number higher than about 500 mg-KOH/g and which is still practicable with respect to physical properties such as viscosity is not available under the existing technical circumstances.

When the metal sulfonate has a base number of less than about 200 mg-KOH/g, the amount of the metal carbonate precipitated in the sulfonate or the metal oxide liberated from the carbonate, which serves as a carrier to assist the introduction of the metal sulfonate lubricant into the working interface, is decreased and the desired prevention of galling and reduction in roll wear may not be attained sufficiently in some cases. However, when the rolling conditions are not so severe or the steel to be rolled is a carbon steel, such a metal sulfonate having a base number of less than about 200 mg-KOH/g and not less than about 40 mg-KOH/g can be used satisfactorily.

Overbased metal sulfonates, particularly calcium sulfonates, having various base numbers are commercially available as a detergent-dispersant, and such a commercially available sulfonate can be used in the present invention as long as it has a base number of at least 40 mg-KOH/g.

The lubricating composition according to the present invention can be prepared by incorporating the overbased metal sulfonate in a base lubricating oil in such a proportion that the metal sulfonate comprises from about 20% to about 70% by weight of the total composition. The lubricating composition may further comprise one or more optional additives selected from those conventionally employed in lubricating compositions. Useful additives include solid lubricants, extreme pressure additives, antioxidants, pour point depressants, viscosity index improvers, and the like.

Examples of base lubricating oils suitable for use in the present invention include oils and fats such as mineral oils, synthetic lubricating oils, rapeseed oil, and lard oil, as well as higher fatty acids and their esters.

Useful solid lubricants include graphite, molybdenum disulfide, boron nitride, mica, and talc.

Useful extreme pressure additives include sulfur-containing organic substances such as sulfidized oil and fats, sulfidized mineral oils, and dinonyl polysulfide, as well as phosphorus-containing organic substances such as tricresyl phosphate and dioctyl phosphate.

Useful antioxidants include bisphenols such as methylene-4,4-bis(2,6-di-tert-butylphenol), alkylphenols such as di-tert-butylcresol, and naphthylamines.

Examples of useful pour point depressants and viscosity index improvers include polymethacrylates and polyolefins.

The amounts of these additives, if added to the lubricating composition, are from about 1% to about 10% for solid lubricants, from about 1% to about 15% for extreme pressure additives, from about 0.01% to about 1% for antioxidants, and from about 1% to about 5% each for pour point depressants and viscosity index improvers, based on the total weight of the composition.

Figure 4:
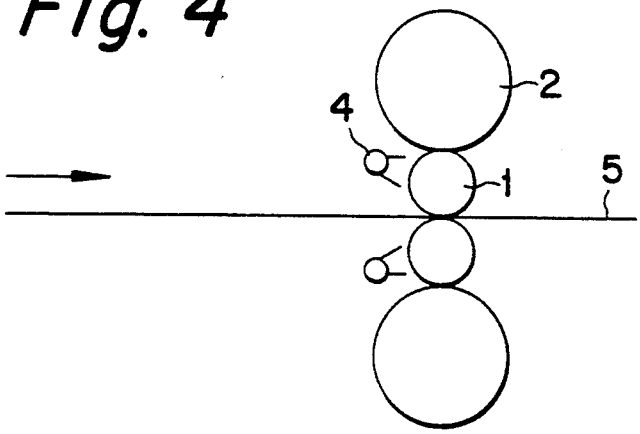
Figure 5:
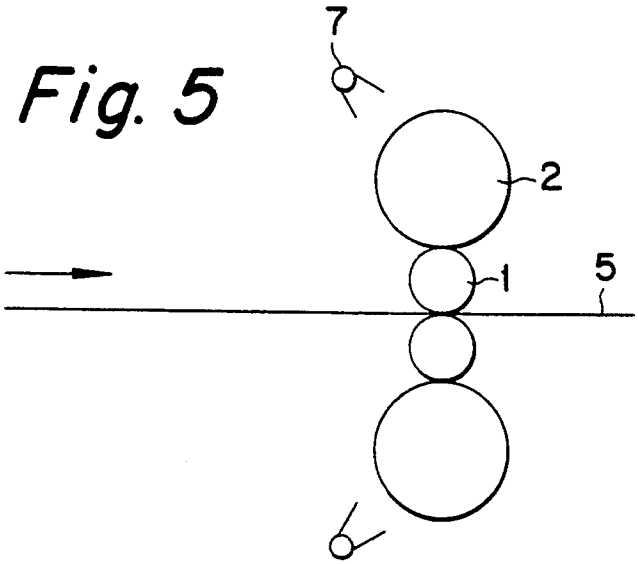

The lubricating composition of the present invention may be applied to only at least one pair of the work rolls in a mill line according to any conventional lubricating method. In this case, the lubricating composition may be applied to the work rolls 1,1 either directly through nozzles 4,4 as shown in FIG. 4, or via backup rolls 2,2 by spraying the lubricating composition onto the backup rolls through nozzles 7,7 as shown in FIG. 5. Since the steel 5 to be rolled is brought into contact with the lubricating composition for the period during which it is rolled by the work rolls, the duration of contact of the steel with the lubricating composition is very limited, usually on the order of a hundredth of a second or shorter. In spite of contact for such a limited period, the lubricating composition provides the steel with good lubricity.

Figure 2:
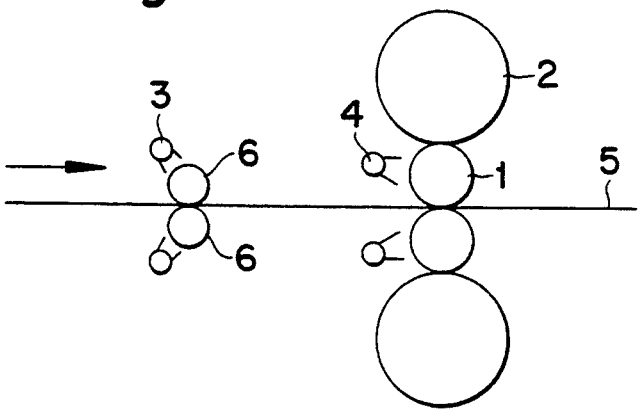
Figure 3:
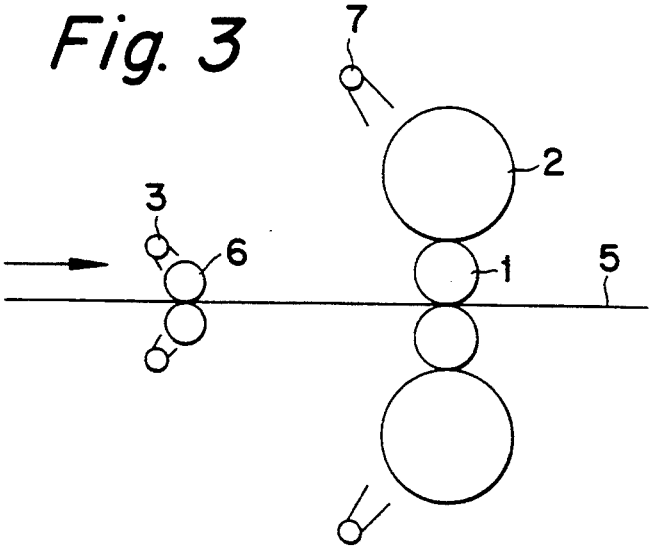

In a preferred embodiment, the lubricating composition is applied to both the work rolls and the steel to be rolled (before it is hot rolled) separately as shown in FIGS. 1 to 3, thereby making it possible to extend the duration of contact of the steel with the lubricating composition.

When applied to a steel to be rolled which has been heated to a hot rolling temperature, a conventional lubricating composition is normally burnt out due to its relatively low heat resistance before it spreads over the steel to perform the desired lubricating activities. Consequently, it is usually applied only to the work rolls.

In contrast, the overbased metal sulfonate used in the present invention has much improved heat resistance and it can exert its lubricating activities without burning out when applied to the heated steel prior to hot rolling. The extended duration of contact of the steel with the lubricating composition attained by application of the composition to the steel prior to hot rolling allows the metal sulfonate to react with the steel surface sufficiently so as to form a lubricating film on the surface.

Application of the lubricating composition to the work rolls also forms a lubricating film on the surface of the rolls. As a result, the contacting surfaces of the rolls and the steel are both covered with a lubricating film, and hence a greater lubricating effect can be attained. Thus, the roll wear can be further reduced and the steel can be completely prevented from galling or suffering surface flaws even it is a high-Cr stainless steel which is particularly susceptible to galling. Also in this case, a descaling effect of the metal sulfonate as a detergent-dispersant is also attainable to a greater degree. Therefore, the formation of scale flaws can be prevented more effectively and the amount of debris remaining on the surface of the hot-rolled product is minimized.

Again, the lubricating composition can be applied to the work rolls either directly as shown in FIGS. 1 and 2 or via their backup rolls as shown in FIG. 3.

Although the lubricating composition may be applied to the steel directly through nozzles 3,3 as shown in FIG. 1, it is preferred that the composition be applied to the steel through idler pinch rolls 6,6 located immediately before the work rolls, as shown in FIGS. 2 and 3, since it is possible to spread the composition over the steel in a more uniform and stable manner. It is desirable that the surfaces of the idler pinch rolls be somewhat roughened in order to prevent slippage upon contacting the steel and increase the amount of the lubricating composition introduced onto the steel. More specifically, the pinch rolls may have dull or dimpled surfaces formed by irradiation with a laser beam, discharge machining, or shot blasting. The resulting dimples may have a depth in the range of 0.5 mm to 1.5 mm and the dimpled area may be from 30% to 60% of the area of the pinch rolls.

In another preferred embodiment, a lubricating composition comprising from 20% to 70% by weight of an overbased metal sulfonate is applied to the work rolls during hot rolling in such a manner that the base number of the overbased metal sulfonate present in the composition is higher in the edge portions on both sides of the circumferential surface of each work roll than in the central portion thereof.

It is known that the edge portions of the barrel of work rolls are more susceptible to galling and undergo more severe roll wear than the central portions thereof during hot rolling. As a result, local wear called cat's ear is observed in each edge portion of the work rolls. In addition, the roll edge portions suffer surface roughening due to galling to a greater extent, resulting in the phenomenon called banding in those portions.

In order to alleviate galling and roll wear in roll edge portions, it has been attempted to apply to the edge portions a special lubricating composition which contains a solid lubricant such as graphite and which has higher lubricity, in addition to a normal lubricating oil which is applied to the entire surface of the work rolls. However, this produces a discontinuity in lubricity at the boundaries of the special lubricating composition due to the different natures of these two lubricants, thereby causing slippage of the steel or galling.

According to the present invention, the lubricity of the lubricating composition depends on the base number of the overbased metal sulfonate present in the composition. Therefore, two classes of lubricating compositions having different degrees of lubricity but similar basic compositions can be prepared merely by varying the base numbers of the metal sulfonates used in the compositions.

One of the lubricating compositions (first composition) containing the metal sulfonate having a higher base number and hence a higher degree of lubricity is solely applied to the edge portions on both sides of the barrel of each work roll. The edge portions correspond to those portions where the phenomenon called cat's ear is normally observed and they usually have a width in the range of 200 mm to 250 mm on opposite sides of the surface of each roll barrel.

The other lubricating composition (second composition) containing the metal sulfonate having a lower base number may be applied either solely to the central portion of the surface of the roll barrel or to the entire surface of the roll barrel.

Figure 6:
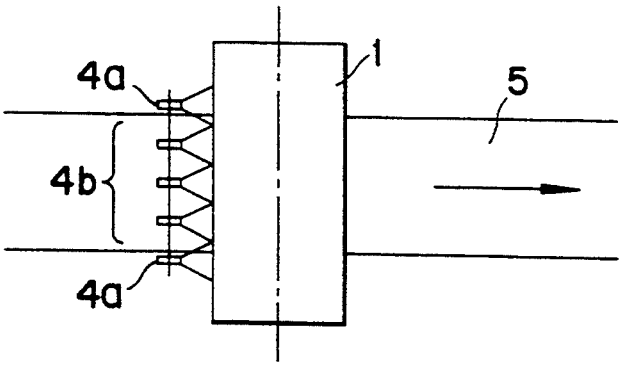
FIG. 6 is a schematic plane view showing an embodiment the lubricating method of the present invention.

In a specific embodiment shown in FIG. 6, several nozzles **4*a* and 4*b* are arranged in a row along the axis of each work roll 1 so as to apply lubricating compositions to the work roll either directly or through its backup roll during hot working of steel sheet 5. The first lubricating composition in which the metal sulfonate has a higher base number is applied through nozzles 4*a* (end nozzles) located on both ends of the nozzle row while the remaining nozzles 4*b* (intermediate nozzles) located between nozzles 4*a*** are used to apply the second composition in which the metal sulfonate has a lower base number.

It is preferred that the metal sulfonate present in the edge portions have a base number of 200 mg-KOH/g or higher while the metal sulfonate present in the central portion have a base number of less than 200 mg-KOH/g. Since the two classes of lubricating composition are of similar nature, they are admixed homogeneously at the boundaries to eliminate the occurrence of discontinuities in lubricity.

The application of the lubricating composition of the present invention can be performed by a conventional lubrication method. For example, it can be applied by the air atomizing method, the water injection method, or the steam atomizing method. Alternatively, it may be applied by coating the composition as is or after dilution, for example, so as to convert it into a nonflammable water-soluble lubricating composition.

The lubricating composition of the present invention is effective for use in hot rolling of various steels including common stainless steels and high-Cr stainless steels containing 20% by weight or more of Cr. It is also useful in hot rolling of carbon steels at a relatively low temperature or at a higher reduction ratio. It can be used not only in sheet rolling but also in caliber rolling to produce shapes, rods, or pipes.

The following examples are presented to further illustrate the present invention. These examples are to be considered in all respects as illustrative and not restrictive.

EXAMPLES

Example 1

The lubricating compositions shown in Tables 1 and 2 were prepared by admixing the ingredients in a homomixer. The compositions shown in Table 1 consisted of 40% by weight of one or more overbased metal sulfonates and 60% by weight of a commercially available hot rolling oil which was a mixture of mineral oil, rapeseed oil, and $\alpha$-olefin polymer oil. When two or more metal sulfonates were used, the base number indicated in Tables 1 and 2 was the weighted average value of the base numbers of the respective sulfonates.

Each of the lubricating compositions were subjected to the following hot rolling tests (Tests 1 to 3) to evaluate their lubricity. In each hot rolling test, the lubricating composition to be tested was applied directly to the work rolls as shown in FIG. 4 without lubrication of the steel to be rolled.

(Test 1)

Each lubricating composition shown in Table 1 or 2 was applied to each of the work rolls of three four-high hot strip mills located immediately before the finish tandem mill during rolling of a stainless steel (JIS SUS 304, about 2000 tons) and a carbon steel (0.08% C-1.0% Mn, about 3000 tons) in a hot sheet mill line. The work rolls were made of a high-Cr cast iron (2.8% C-18% Cr). Application of the lubricating composition to the work rolls was performed by using a lubrication apparatus of the air atomization type.

Galling of the work rolls during hot rolling and the surface conditions (surface flaws) of the hot-rolled steel sheet after it had been pickled were evaluated by visual observation. In addition, the wear rate (maximum wear depth) was determined by measuring the maximum wear depth of the upper and lower work rolls of a predetermined stand with a profile meter and calculating the mean of the measured values.

The test results are shown in Table 3 for JIS SUS 304 stainless steel and Table 4 for carbon steel.

TABLE 1

(wt %)

| Run No. | Base number of metal sulfonate[1)] | Metal sulfonate[2)] A | B | C | D | E | F | G | Hot rolling oil[3)] | Remarks |
|---|---|---|---|---|---|---|---|---|---|---|
| 1 | 40 mg-KOH/g | | 40 | | | | | | 60 | This Invention |
| 2 | 200 mg-KOH/g | | | 40 | | | | | 60 | This Invention |
| 3 | 400 mg-KOH/g | | | | 40 | | | | 60 | This Invention |
| 4 | 400 mg-KOH/g | | | | | 40 | | | 60 | This Invention |
| 5 | 70 mg-KOH/g | | | | | | 40 | | 60 | This Invention |
| 6 | 300 mg-KOH/g | | | 20 | | 20 | | | 60 | This Invention |
| 7 | 150 mg-KOH/g | | | 25 | | | 15 | | 60 | This Invention |
| 8 | 300 mg-KOH/g | | | | | 28 | 12 | | 60 | This Invention |
| 9 | 350 mg-KOH/g | | | 8 | | 31 | 1 | | 60 | This Invention |
| 10 | 400 mg-KOH/g | | | | 20 | 20 | | | 60 | This Invention |

TABLE 1-continued (wt %)

| Run No. | Base number of metal sulfonate[1)] | Metal sulfonate[2)] A | B | C | D | E | F | G | Hot rolling oil[3)] | Remarks |
|---|---|---|---|---|---|---|---|---|---|---|
| 11 | 22 mg-KOH/g | 40 | | | | | | | 60 | Comparative |
| 12 | 10 mg-KOH/g | 12 | | | | | | 28 | 60 | Comparative |

TABLE 2

(wt %)

| Run No. | Base number of metal sulfonate[1)] | Metal Sulfonate[2)] C | D | E | Hot rolling oil[3] | Remarks |
|---|---|---|---|---|---|---|
| 13 | 300 mg-KOH/g | 15 | | 15 | 70 | This Invention |
| 14 | 300 mg-KOH/g | 30 | | 30 | 40 | This Invention |
| 15 | 400 mg-KOH/g | | 13 | 13 | 74 | This Invention |
| 16 | 400 mg-KOH/g | | 28 | 28 | 44 | This Invention |
| 17 | 300 mg-KOH/g | 8 | | 8 | 84 | Comparative |
| 18 | 400 mg-KOH/g | | 8 | 8 | 84 | Comparative |
| 19 | Graphite[4)] (20), water (78), and sodium carboxymethlcellulose (2) | | | | | Conventional |
| 20 | Mineral oil[5)] (50), Rapeseed oil (20), iron oxide powder[6)] (20), and polymethacrylate (10) | | | | | Conventional |

[1)]Average base number when two or more sulfonates were used.
[2)]A: Based calcium sulfonate having a base number of 22 mg-KOH/g.
B: Overbased calcium sulfonate having a base number of 40 mg-KOH/g.
C: Overbased calcium sulfonate having a base number of 200 mg-KOH/g.
D: Overbased calcium sulfonate having a base number of 400 mg-KOH/g.
E: Overbased magnesium sulfonate having a base number of 400 mg-KOH/g.
F: Overbased barium sulfonate having a base number of 70 mg-KOH/g.
G: Based barium sulfonate having a base number of 5 mg-KOH/g.
[3)]Commercially-available hot rolling oil.
[4)]Naturally-occurring graphite having a purity of 98% and an average particle diameter of 3 μm.
[5)]Mineral oil having a viscosity of 90 cst at 40° C.
[6)]Powder of $Fe_2O_3$ having an average particle diameter of 3 μm.

TABLE 3

Hot rolling test of JIS SUS 304 stainless steel (1500 ~ 2000 tons)

| Run No. | Sulfonate Base No. mg-KOH/g | Sulfonate wt % | Galling of work rolls | Maximum depth of roll wear | Surface flaws of hot-rolled products | Remarks |
|---|---|---|---|---|---|---|
| 1 | 40 | 40 | V.S.[1)] | 96 μm | None | This Invention |
| 2 | 200 | 40 | None | 77 μm | None | This Invention |
| 3 | 400 | 40 | None | 55 μm | None | This Invention |
| 4 | 400 | 40 | None | 91 μm | None | This Invention |
| 5 | 70 | 40 | V.S.[1)] | 101 μm | None | This Invention |
| 6 | 300 | 40 | None | 80 μm | None | This Invention |
| 7 | 150 | 40 | V.S.[1)] | 85 μm | None | This Invention |
| 8 | 300 | 40 | None | 73 μm | None | This Invention |
| 9 | 350 | 40 | None | 68 μm | None | This Invention |
| 10 | 400 | 40 | None | 52 μm | None | This Invention |
| 11 | 22 | 40 | Moderate | 315 μm | Partial flaws | Comparative |
| 12 | 10 | 40 | Severe | 370 μm | Entire surface | Comparative |
| 13 | 300 | 30 | None | 64 μm | None | This Invention |
| 14 | 300 | 60 | None | 58 μm | None | This Invention |
| 15 | 400 | 26 | None | 60 μm | None | This Invention |
| 16 | 400 | 56 | None | 44 μm | None | This Invention |
| 17 | 300 | 16 | Moderate | 129 μm | Partial flaws | Comparative |
| 18 | 400 | 16 | Moderate | 121 μm | Partial flaws | Comparative |
| 19 | — | — | Severe | 280 μm | Entire surface | Conventional |
| 20 | — | — | Severe | 322 μm | Entire surface | Conventional |

[1)]Very slight.

TABLE 4

Hot rolling test on carbon steel (2500 ~ 3000 tons)

| Run No. | Sulfonate Base No. mg-KOH/g | Sulfonate wt % | Galling of work rolls | Maximum depth of roll wear | Surface flaws of hot-rolled products | Remarks |
|---|---|---|---|---|---|---|
| 1 | 40 | 40 | None | 134 μm | None | This Invention |

TABLE 4-continued

| Run No. | Hot rolling test on carbon steel (2500 ~ 3000 tons) Sulfonate Base No. mg-KOH/g | wt % | Galling of work rolls | Maximum depth of roll wear | Surface flaws of hot-rolled products | Remarks |
|---|---|---|---|---|---|---|
| 2 | 200 | 40 | None | 111 μm | None | This Invention |
| 3 | 400 | 40 | None | 83 μm | None | This Invention |
| 4 | 400 | 40 | None | 125 μm | None | This Invention |
| 5 | 70 | 40 | V.S.[1)] | 138 μm | None | This Invention |
| 6 | 300 | 40 | None | 118 μm | None | This Invention |
| 7 | 150 | 40 | None | 122 μm | None | This Invention |
| 8 | 300 | 40 | None | 103 μm | None | This Invention |
| 9 | 350 | 40 | None | 99 μm | None | This Invention |
| 10 | 400 | 40 | None | 76 μm | None | This Invention |
| 11 | 22 | 40 | Slight | 412 μm | Slight flaws | Comparative |
| 12 | 10 | 40 | Moderate | 431 μm | Partial flaws | Comparative |
| 13 | 300 | 30 | None | 94 μm | None | This Invention |
| 14 | 300 | 60 | None | 87 μm | None | This Invention |
| 15 | 400 | 26 | None | 90 μm | None | This Invention |
| 16 | 400 | 56 | None | 72 μm | None | This Invention |
| 17 | 300 | 16 | Slight | 188 μm | Slight flaws | Comparative |
| 18 | 400 | 16 | Slight | 123 μm | Slight flaws | Comparative |
| 19 | — | — | Moderate | 318 μm | Partial flaws | Conventional |
| 20 | — | — | Moderate | 410 μm | Partial flaws | Conventional |

[1)]Very slight.

As is apparent from the results shown in Tables 3 and 4, the work rolls could be protected against galling and the hot-rolled sheets were free from surface flaws in most runs according to this invention when the lubricating composition contained an overbased metal sulfonate having a base number of at least 40 mg-KOH/g in a concentration of from 20% to 70% by weight. The lubricity was particularly improved when the concentration of the metal sulfonate was between 30% and 60% or when the base number of the metal sulfonate was 200 mg-KOH/g or higher. Among various alkaline earth metal sulfonate salts tested, i.e., Ca, Ba, and Mg salts, having the same base number, the lubricity was highest in Ca sulfonates and lower in the order of Mg sulfonates and Ba sulfonates.

In contrast, in the comparative and conventional runs, severe galling of the work rolls was observed during hot rolling and the hot-rolled sheets had surface flaws.

The wear rate was greatly reduced in all the runs according to this invention compared to the comparative and conventional runs.

The same results as above were obtained when the work rolls made of a high-Cr cast iron were replaced by other rolls conventionally employed in hot rolling such as those made of a high-carbon type high speed steel, indefinite chilled cast iron, or adamite.

(Test 2)

Using a lubrication apparatus of the water injection type, each lubricating composition shown in Tables 1 and 2 was applied to the caliber rolls (sizer rolls and mandrel mill rolls) of all the mill stands during hot rolling of a carbon steel or a stainless steel such as JIS SUS 304 into tubes in a mandrel mill line. No galling of the rolls or surface flaws of the hot-rolled product were observed when a lubricating composition according to this invention was used. In contrast, severe galling and serious surface flaws were observed on the rolls and the hot-rolled tubes, respectively, in the comparative and conventional runs, and the wear rate was also much higher in those runs.

(Test 3)

Using a lubrication apparatus of the water-injection type, each lubricating composition shown in Tables 1 and 2 was applied to the horizontal rolls and vertical rolls of a finish mill during hot rolling of a carbon steel or a stainless steel such as JIS SUS 304 or JIS SUS 430 into H-beams in a shape mill line. Again, no galling of the rolls or surface flaws of the hot-rolled product were observed when a lubricating composition according to this invention was used. In contrast, severe galling and serious surface flaws were observed on the rolls and the hot-rolled H-beams, respectively, in the comparative and conventional runs, and the wear rate was also much higher in those runs.

Example 2

Lubricating compositions shown in Table 5 which contained an overbased Ca sulfonate were prepared in the same manner described in Example 1 and they were tested generally in the same manner as described in Tests 1 to 3 of Example 1.

(Test 1)

Each lubricating composition was tested by hot sheet rolling of JIS SUS 304 stainless steel (about 2000 tons) and high-Cr stainless steel (about 500 tons) in the same manner as described in Test 1 of Example 1 except that the lubrication apparatus used was of the water injection type.

The test results on JIS SUS 304 stainless steel and high-Cr stainless steel are summarized in Tables 6 and 7, respectively.

TABLE 5

(wt %)

| Run No. | Mineral Oil[1)] | Rape seed oil | α-Olefin polymer oil | Hot rolling oil | Calcium sulfonate A[2)] | B[3)] | C[4)] | Size distribution of precipitated $CaCO_3$ particles | Remarks |
|---|---|---|---|---|---|---|---|---|---|
| 1 | 30 | — | — | — | 70 | — | — | <150 Å | This invention |
| 2 | 40 | 30 | — | — | 30 | — | — | <150 Å | This invention |
| 3 | — | 30 | 50 | — | — | 20 | — | <150 Å | This invention |
| 4 | 40 | — | — | — | — | 60 | — | <150 Å | This invention |
| 5 | — | — | — | 60 | — | 40 | — | <150 Å | This invention |
| 6 | — | — | — | 70 | — | 30 | — | <150 Å | This invention |
| 7 | 30 | — | — | — | — | — | 70 | <150 Å | This invention |
| 8 | 30 | 30 | — | — | — | — | 40 | <150 Å | This invention |
| 9 | — | — | — | 95 | — | 5 | — | <150 Å | This invention |
| 10 | Graphite[5)] (20), sodium carboxymethyl cellulose (2), and water (78) | | | | | | | | Conventional |
| 11 | 50 | 20 | iron oxide powder[6)] (20), and polymethacyrlate (10) | | | | | | Conventional |

[1)]Mineral oil: Viscosity 90 cst at 40° C.
[2)]Overbased calcium sulfonate having a base number of 200 mg-KOH/g.
[3)]Overbased calcium sulfonate having a base number of 400 mg-KOH/g.
[4)]Overbased calcium sulfonate having a base number of 40 mg-KOH/g.
[5)]Naturally-occurring graphite having a purity of 98% and an average particle diameter of 3 μm.
[6)]Powder of $Fe_2O_3$ having an average particle diameter of 3 μm.

TABLE 6

Hot rolling test on JIS SUS 304 stainless steel (about 2000 tons)

| Run No. | Galling of work rolls | Maximum depth of roll wear | Suface flaws of hot-rolled products | Mill trouble | Remarks |
|---|---|---|---|---|---|
| 1 | None | 150 μm | None | No | This Invention |
| 2 | None | 175 μm | None | No | This Invention |
| 3 | None | 130 μm | None | No | This Invention |
| 4 | None | 110 μm | None | No | This Invention |
| 5 | None | 85 μm | None | Yes[1)] | This Invention |
| 6 | None | 105 μm | None | No | This Invention |
| 7 | None | 210 μm | None | No | This Invention |
| 8 | None | 220 μm | None | No | This Invention |
| 9 | Moderate | 300 μm | Partial flaws | No | Comparative |
| 10 | Moderate | 295 μm | Partial flaws | Yes[1)] | Conventional |
| 11 | Severe | 350 μm | Entire surface | No | Conventional |

[1)]Failure of smooth insertion of the steel into the roll gap and slippage of the steel during hot rolling.

TABLE 7

Hot rolling test on 20%-Cr stainless steel (about 500 tons)

| Run No. | Galling of work rolls | Maximum depth of roll wear | Suface flaws of hot-rolled products | Mill trouble | Remarks |
|---|---|---|---|---|---|
| 1 | None | 60 μm | None | No | This Invention |
| 2 | None | 70 μm | None | No | This Invention |
| 3 | None | 50 μm | None | No | This Invention |
| 4 | None | 40 μm | None | No | This Invention |
| 5 | None | 25 μm | None | Yes[1)] | This Invention |
| 6 | None | 35 μm | None | No | This Invention |
| 7 | Slight | 95 μm | Very slight | No | This invention |
| 8 | Slight | 105 μm | Very slight | No | This invention |
| 9 | Severe | 190 μm | Entire surface | No | Comparative |
| 10 | Severe | 175 μm | Entire surface | Yes[1)] | Conventional |
| 11 | Severe | 215 μm | Entire surface | No | Conventional |

[1)]Failure of smooth insertion of the steel into the roll gap and slippage of the steel during hot rolling.

As is apparent from the results shown in Tables 6 and 7, the work rolls could be prevented from galling and the hot-rolled sheets were free from surface flaws in most runs according to this invention even in the cases where the steel to be rolled was a high-Cr stainless steel, which is highly susceptible to galling. The extremely slight flaws observed in Runs Nos. 7 and 8 of Table 7 were not serious and they needed no dressing. In contrast, severe galling and serious surface flaws were observed on the work rolls and the hot-rolled products, respectively, in the comparative and conventional runs. Furthermore, the wear rate was greatly reduced in all the runs according to this invention compared to the comparative and conventional runs.

Slippage was observed in Run No. 5 since the lubricating composition decreased the friction at the roll gaps too much. Such trouble can be eliminated by growing the calcium carbonate fine particles as illustrated in Example 3.

The same results as above were obtained when the work rolls made of a high-Cr cast iron were replaced by other rolls conventionally employed in hot rolling such as those made of a high-carbon type high speed steel, indefinite chilled cast iron, or adamite.

(Test 2)

Each lubricating composition shown in Table 5 was tested by hot tube rolling of a stainless steel such as JIS SUS 304 in the same manner as described in Test 2 of Example 1 except that the lubrication apparatus used was of the air atomization type. When a lubricating composition according to this invention was used, no galling of the rolls or surface flaws of the hot-rolled products were observed. In contrast, severe galling and serious surface flaws were observed on the rolls and the hot-rolled tubes, respectively, in the comparative and conventional runs.

(Test 3)

Each lubricating composition shown in Table 5 was tested by hot shape rolling into H-beams of a stainless steel such as JIS SUS 304 or JIS SUS 430 in the same manner as described in Test 3 of Example 1. No galling of the rolls or surface flaws of the hot-rolled products were observed when a lubricating composition according to this invention was used. In contrast, severe galling and serious surface flaws were observed on the rolls and the hot-rolled H-beams, respectively, in the comparative and conventional runs, and the wear rate was also much higher in those runs.

Example 3

Lubricating compositions shown in Table 8, which contained an overbased Ca sulfonate, were prepared in the same manner as described in Example 1. The calcium carbonate particles precipitated in the overbased Ca sulfonate had been grown by the addition of a polar substance (water) so as to have a particle diameter of at least about 150 angstrom. The resulting compositions were tested in accordance with the testing procedures of Tests 1 to 3 described in Example 2. The results of hot rolling of about 1800 tons of SUS 304 stainless steel and about 400 tons of high-Cr stainless steel in Test 1 are summarized in Tables 9 and 10, respectively.

properties of the sulfonates were substantially maintained.

The test results in Test 1 showed the same tendency as in Example 2. Also in Tests 2 and 3, the lubricating compositions according to this invention afforded hot-rolled products which were free from surface flaws without galling of the work rolls and with a significantly decreased roll wear.

(wt %)

| Run No. | Mineral Oil[1)] | Rape seed oil | α-Olefin polymer oil | Hot rolling oil | Calcium sulfonate A[2)] | B[3)] | C[4)] | Size distribution of precipitated $CaCO_3$ particles | Remarks |
|---|---|---|---|---|---|---|---|---|---|
| 1 | 30 | — | — | — | 70 | — | — | 150 ~ 5000 Å | This invention |
| 2 | 40 | 30 | — | — | 30 | — | — | 150 ~ 5000 Å | This invention |
| 3 | — | 30 | 50 | — | — | 20 | — | 150 ~ 5000 Å | This invention |
| 4 | 40 | — | — | — | — | 60 | — | 150 ~ 5000 Å | This invention |
| 5 | — | — | — | 60 | — | 40 | — | 150 ~ 5000 Å | This invention |
| 6 | — | — | — | 70 | — | 30 | — | 150 ~ 5000 Å | This invention |
| 7 | 30 | — | — | — | — | — | 70 | 150 ~ 5000 Å | This invention |
| 8 | 30 | 30 | — | — | — | — | 40 | 150 ~ 5000 Å | This invention |
| 9 | — | — | — | 95 | — | 5 | — | 150 ~ 5000 Å | This invention |

[1)]Mineral oil: Viscosity 90 cst at 40° C.

[2)]Overbased calcium sulfonate having a base number of 200 mg-KOH/g.

[3)]Overbased calcium sulfonate having a base number of 400 mg-KOH/g.

[4)]Overbased calcium sulfonate having a base number of 40 mg-KOH/g.

TABLE 9

Hot rolling test on JIS SUS 304 stainless steel (about 1800 tons)

| Run No. | Galling of work rolls | Maximum depth of roll wear | Suface flaws of hot-rolled products | Mill trouble | Remarks |
|---|---|---|---|---|---|
| 1 | None | 130 μm | None | No | This invention |
| 2 | None | 145 μm | None | No | This invention |
| 3 | None | 120 μm | None | No | This invention |
| 4 | None | 105 μm | None | No | This invention |
| 5 | None | 80 μm | None | No | This invention |
| 6 | None | 100 μm | None | No | This invention |
| 7 | None | 175 μm | None | No | This invention |
| 8 | None | 185 μm | None | No | This invention |
| 9 | Moderate | 290 μm | Partial flaws | No | Comparative |

TABLE 10

Hot rolling test on 20%-Cr stainless steel (about 400 tons)

| Run No. | Galling of work rolls | Maximum depth of roll wear | Suface flaws of hot-rolled products | Mill trouble | Remarks |
|---|---|---|---|---|---|
| 1 | None | 65 μm | None | No | This invention |
| 2 | None | 70 μm | None | No | This invention |
| 3 | None | 55 μm | None | No | This invention |
| 4 | None | 45 μm | None | No | This invention |
| 5 | None | 30 μm | None | No | This invention |
| 6 | None | 35 μm | None | No | This invention |
| 7 | Very slight | 85 μm | Very slight | No | This invention |
| 8 | Very slight | 90 μm | Very slight | No | This invention |
| 9 | Severe | 185 μm | Entire surface | No | Comparative |

By growing the calcium carbonate particles precipitated in the overbased calcium sulfonates, slippage could be eliminated completely while the lubricating

Example 4

The lubricating compositions shown in Table 11, which contained an overbased Ca sulfonate, were prepared in the same manner as described in Example 1. The overbased Ca sulfonate used in this example was the same as used in Example 2, i.e., containing non-grown calcium carbonate particles having a particle diameter below 150 angstrom. Each lubricating composition was tested according to the testing procedures of Tests 1 to 3 of Example 1.

In this example, application of the lubricating compositions was performed by the following two methods. In a first method (hereinafter referred to as this invention method), a lubricating composition to be tested was applied to both the work rolls and the steel to be rolled (before hot rolling) as shown in FIG. 2. A second method was the conventional lubrication method in which a lubricating composition was applied only to the work rolls as shown in FIG. 4. The application of the lubricating composition to the work rolls was performed directly in the first and second methods, while the application thereof to the steel in the first method was performed through the pinch rolls located immediately before the mill.

(Test 1)

Each lubricating composition was tested by hot sheet rolling of a carbon steel (about 3000 tons), JIS SUS 304 stainless steel (about 1800 tons), and high-Cr stainless steel (about 400 tons) in the same manner as described in Test 1 of Example 1 except that the lubricating composition was applied to both the work rolls and the steel in the first this invention lubrication method as described above.

The test results on the carbon steel, JIS SUS 304 stainless steel, and high-Cr stainless steel are summarized in Tables 12, 13, and 14, respectively.

TABLE 11

(wt %)

| Run No. | Mineral Oil[1)] | Rape seed oil | α-Olefin polymer oil | Hot rolling oil | Calcium sulfonate A[2)] | B[3)] | C[4)] | Size distribution of precipitated $CaCO_3$ particles | Remarks |
|---|---|---|---|---|---|---|---|---|---|
| 1 | 30 | — | — | — | 70 | — | — | <150 Å | This invention |
| 2 | 40 | 30 | — | — | 30 | — | — | <150 Å | This invention |
| 3 | — | 30 | 50 | — | — | 20 | — | <150 Å | This invention |
| 4 | 40 | — | — | — | — | 60 | — | <150 Å | This invention |
| 5 | — | — | — | 60 | — | 40 | — | <150 Å | This invention |
| 6 | — | — | — | 70 | — | 30 | — | <150 Å | This invention |
| 7 | 30 | — | — | — | — | — | 70 | <150 Å | This invention |
| 8 | 30 | 30 | — | — | — | — | 40 | <150 Å | This invention |
| 9 | — | — | — | 95 | — | 5 | — | <150 Å | Comparative |
| 10 | — | — | — | 100 | — | — | — | — | Comparative |
| 11 | Graphite[5)] (20), sodium carboxymethyl cellulose (2), and water (78) | | | | | | | | Conventional |
| 12 | 50 | 20 | iron oxide powder[6)] (20), and polymethacyrlate (10) | | | | | | Conventional |

[1)]Mineral oil: Viscosity 90 cst at 40° C.
[2)]Overbased calcium sulfonate having a base number of 200 mg-KOH/g.
[3)]Overbased calcium sulfonate having a base number of 400 mg-KOH/g.
[4)]Overbased calcium sulfonate having a base number of 40 mg-KOH/g.
[5)]Naturally-occurring graphite having a purity of 98% and an average particle diameter of 3 μm.
[6)]Powder of $Fe_2O_3$ having an average particle diameter of 3 μm.

TABLE 12

Hot rolling test on carbon steel (about 3000 tons)

| Run No. | This Invention Method (FIG. 2) Galling | Roll Wear[1] | Cleanness[2] | Flaws[3] | Conventional Method (FIG. 4) Galling | Roll Wear[1] | Cleanness[2] | Flaws[3] | |
|---|---|---|---|---|---|---|---|---|---|
| 1 | None | 105 μm | Good | None | None | 155 μm | Good | None | TI |
| 2 | None | 125 μm | Good | None | None | 170 μm | Good | None | TI |
| 3 | None | 100 μm | Good | None | None | 140 μm | Good | None | TI |
| 4 | None | 95 μm | Good | None | None | 130 μm | Good | None | TI |
| 5 | None | 80 μm | Good | None | None | 115 μm | Good | None | TI |
| 6 | None | 70 μm | Good | None | None | 100 μm | Good | None | TI |
| 7 | None | 140 μm | Good | None | None | 210 μm | Good | None | TI |
| 8 | None | 155 μm | Good | None | None | 215 μm | Good | None | TI |
| 9 | Slight | 305 μm | Poor | VS[4] | Slight | 320 μm | Poor | VS[4] | CP |
| 10 | Moderate | 410 μm | Poor | PF[5] | Moderate | 400 μm | Poor | PF[5] | CP |
| 11 | Slight | 320 μm | Poor | VS[4] | Slight | 330 μm | Poor | VS[4] | CV |
| 12 | Moderate | 400 μm | Poor | PF[5] | Moderate | 410 μm | Poor | PF[5] | CV |

TI = This Invention; CP = Comparative; CV = Conventional.
[1]: Maximum depth of roll wear.
[2]: The cleanness of the surface of hot-rolled product.
[3]: Surface flaws of hot-rolled product.
[4]: Very slight flaws.
[5]: Partial flaws.

TABLE 13

Hot rolling test on JIS SUS 304 stainless steel (about 1800 tons)

| Run No. | This Invention Method (FIG. 2) Galling | Roll Wear[1] | Cleanness[2] | Flaws[3] | Conventional Method (FIG. 4) Galling | Roll Wear[1] | Cleanness[2] | Flaws[3] | |
|---|---|---|---|---|---|---|---|---|---|
| 1 | None | 80 μm | Good | None | None | 140 μm | Good | None | TI |
| 2 | None | 85 μm | Good | None | None | 165 μm | Good | None | TI |
| 3 | None | 70 μm | Good | None | None | 120 μm | Good | None | TI |
| 4 | None | 60 μm | Good | None | None | 100 μm | Good | None | TI |
| 5 | None | 45 μm | Good | None | None | 75 μm | Good | None | TI |
| 6 | None | 50 μm | Good | None | None | 90 μm | Good | None | TI |
| 7 | None | 100 μm | Good | None | None | 200 μm | Good | None | TI |
| 8 | None | 110 μm | Good | None | None | 205 μm | Good | None | TI |
| 9 | Moderate | 300 μm | Poor | PF[5] | Moderate | 300 μm | Poor | PF[5] | CP |
| 10 | Severe | 365 μm | Poor | EF[6] | Severe | 360 μm | Poor | EF[6] | CP |
| 11 | Moderate | 290 μm | Poor | PF[5] | Moderate | 290 μm | Poor | PF[5] | CV |
| 12 | Severe | 330 μm | Poor | EF[6] | Severe | 340 μm | Poor | EF[6] | CV |

TI = This Invention; CP = Comparative; CV = Conventional.
[1]: Maximum depth of roll wear.
[2]: The cleanness of the surface of hot-rolled product.
[3]: Surface flaws of hot-rolled product.
[5]: Partial flaws.
[6]: Surface flaws on the entire surface.

TABLE 14

| Run No. | Hot rolling test on 20%-Cr stainless steel (abourt 400 tons) This Invention Method (FIG. 2) Galling | Roll Wear[1] | Cleanness[2] | Flaws[3] | Conventional Method (FIG. 4) Galling | Roll Wear[1] | Cleanness[2] | Flaws[3] | |
|---|---|---|---|---|---|---|---|---|---|
| 1 | None | 35 μm | Good | None | None | 55 μm | Good | None | TI |
| 2 | None | 40 μm | Good | None | None | 65 μm | Good | None | TI |
| 3 | None | 30 μm | Good | None | None | 45 μm | Good | None | TI |
| 4 | None | 20 μm | Good | None | None | 30 μm | Good | None | TI |
| 5 | None | 10 μm | Good | None | None | 20 μm | Good | None | TI |
| 6 | None | 15 μm | Good | None | None | 25 μm | Good | None | TI |
| 7 | None | 50 μm | Good | None | Slight | 90 μm | Good | VS[4] | TI |
| 8 | None | 55 μm | Good | None | Slight | 100 μm | Good | VS[4] | TI |
| 9 | Severe | 205 μm | Poor | EF[6] | Severe | 200 μm | Poor | EF[6] | CP |
| 10 | Severe | 200 μm | Poor | EF[6] | Severe | 210 μm | Poor | EF[6] | CP |
| 11 | Severe | 175 μm | Poor | EF[6] | Severe | 180 μm | Poor | EF[6] | CV |
| 12 | Severe | 200 μm | Poor | EF[6] | Severe | 220 μm | Poor | EF[6] | CV |

TI = This Invention; CP = Comparative; CV = Conventional.
[1]: Maximum depth of roll wear.
[2]: The cleanness of the surface of hot-rolled product.
[3]: Surface flaws of hot-rolled product.
[4]: Very slight flaws.
[6]: Surface flaws on the entire surface.

Application of a lubricating composition of this invention to both the work rolls and the steel according to the first this invention lubrication method resulted in a further decrease in roll wear compared to the roll wear obtained with the second (conventional) lubrication method while surface flaws were completely prevented even in hot rolling of a high-Cr stainless steel. It should be noted that the comparative and conventional lubricating compositions, when applied to both the work rolls and the steel in the first method, resulted in a roll wear which remained at the same level as in the second conventional lubrication method. Thus, the further decrease in roll wear attained by the first lubrication method is an effect peculiar to the lubricating compositions according to the present invention.

(Test 2)

Each lubricating composition shown in Table 11 was tested by hot tube rolling of a stainless steel such as JIS SUS 304 and 13 Cr steel in the same manner as described in Test 2 of Example 1 except that the lubricating composition was applied to both the caliber rolls of all the mill stands and the steel to be rolled. When a lubricating composition according to this invention was used, no galling of the rolls or surface flaws of the hot-rolled products were observed. In addition, the roll wear was further decreased compared to Test 2 of Example 2 and the debris remaining on the surface of the hot-rolled product was greatly reduced.

In contrast, severe galling and serious surface flaws were observed on the rolls and the hot-rolled tubes, respectively, in the comparative and conventional runs in spite of the application of these lubricants to both the work rolls and the steel to be rolled.

(Test 3)

Each lubricating composition shown in Table 11 was tested by hot shape rolling of a stainless steel such as JIS SUS 304 and JIS SUS 430 to form H-beams in the same manner as described in Test 3 of Example 1 except that the lubricating composition was applied to both the work rolls (horizontal and vertical rolls) of a finish mill and the steel before hot rolling. The results were the same as described in Test 2 of this example.

Example 5

The lubricating compositions shown in Table 15, which contained an overbased Ca sulfonate, were prepared in the same manner as described in Example 1, and they were each tested by hot sheet rolling of a carbon steel (about 3000 tons) and JIS SUS 304 stainless steel (about 1800 tons) in the same manner as described in Test 1 of Example 1. In each hot rolling test, the lubricating composition to be tested was applied directly to the work rolls as shown in FIGS. 4 using a lubrication apparatus of the water injection type at a pressure of 3–4 kgf/mm$^2$ after it had been diluted to a concentration of 0.1% –0.5% by weight.

In this example, as shown in FIG. 6, two lubricating compositions each containing an overbased Ca sulfonate having a different base number were used and one of them was applied to the edge portions on both sides of the work roll barrel through end nozzles 4*a* located on the opposite ends of the nozzle row. The other lubricating composition was applied to the central portion of the work roll barrel through intermediate nozzles 4*b*. The hot-rolled sheet was about 1000 mm wide and the width of the edge portion was about 200 mm on each side of the sheet.

After each hot rolling, the work rolls lubricated in the above manner were observed visually to determine whether galling and surface roughening were found or not in the edge portions on both side of the barrel surface.

The test results on carbon steel and JIS SUS 304 stainless steel are summarized in Tables 16 and 17, respectively.

TABLE 15

| Lubricant No. | Mineral oil[1)] | Rape seed oil | α-Olefin polymer oil | Hot rolling oil | Calcium sulfonate A[2)] | B[3)] | C[4)] | D[5)] | Remarks |
|---|---|---|---|---|---|---|---|---|---|
| 1 | 30 | — | — | — | 70 | — | — | — | This invention |
| 2 | 40 | 30 | — | — | 30 | — | — | — | This invention |
| 3 | — | 30 | 50 | — | — | 20 | — | — | This invention |
| 4 | 40 | — | — | — | — | 60 | — | — | This invention |

TABLE 15-continued

| Lubricant No. | Mineral oil[1] | Rape seed oil | α-Olefin polymer oil | Hot rolling oil | Calcium sulfonate A[2] | B[3] | C[4] | D[5] | Remarks |
|---|---|---|---|---|---|---|---|---|---|
| 5 | — | — | — | 60 | — | 40 | — | — | This invention |
| 6 | — | — | — | 70 | — | 30 | — | — | This invention |
| 7 | 30 | — | — | — | — | — | — | 70 | This invention |
| 8 | 30 | 30 | — | — | — | — | — | 40 | This invention |
| 9 | 30 | 30 | — | — | — | — | 40 | — | This invention |
| 10 | Graphite[6] (20), sodium carboxymethyl cellulose (2), and water (78) | | | | | | | | Conventional |
| 11 | 50 | 20 | iron oxide powder[7] (20), and polymethacyrlate (10) | | | | | | Conventional |

[1]Mineral oil: Viscosity 90 cst at 40° C.
[2]Overbased calcium sulfonate having a base numnber of 200 mg-KOH/g.
[3]Overbased calcium sulfonate having a base numnber of 400 mg-KOH/g.
[4]Overbased calcium sulfonate having a base numnber of 160 mg-KOH/g.
[5]Overbased calcium sulfonate having a base numnber of 40 mg-KOH/g.
[6]Naturally-occurring graphite having a purity of 98% and an average particle diameter of 3 μm.
[7]Powder of $Fe_2O_3$ having an average particle diameter of 3 μm.

TABLE 16

Hot rolling test on carbon steel (about 3000 tons)

| Test No. | Lubricant number applied to Nozzles 1 | 2 | Galling of work rolls in edge portions | Maximum depth of roll wear | Mill trouble | Remarks |
|---|---|---|---|---|---|---|
| 1 | No. 3 | No. 7 | None | 121 μm | No | This Invention |
| 2 | No. 4 | No. 9 | None | 85 μm | No | This Invention |
| 3 | No. 5 | No. 7 | None | 97 μm | No | This Invention |
| 4 | No. 6 | No. 7 | None | 110 μm | No | This Invention |
| 5 | No. 4 | No. 9 | None | 66 μm | No | This Invention |
| 6 | No. 5 | No. 9 | None | 72 μm | No | This Invention |
| 7 | No. 1 | No. 8 | None | 143 μm | No | This Invention |
| 8 | No. 2 | No. 8 | None | 160 μm | No | This Invention |
| 9 | No. 10 | Oil[1] | Surface roughening | 340 μm | Yes[2] | Conventional |
| 10 | No. 11 | Oil[1] | Galling | 422 μm | No | Conventional |

[1]Commercially available hot-rolling oil as indicated in Table 1.
[2]Failure of smooth insertion of the steel into the roll gap and slippage of the steel during hot rolling.

TABLE 17

Hot rolling test on JIS SUS 304 stainless steel (about 1800 tons)

| Test No. | Lubricant number applied to Nozzles 1 | 2 | Galling of work rolls in edge portions | Maximum depth of roll wear | Mill trouble | Remarks |
|---|---|---|---|---|---|---|
| 1 | No. 3 | No. 7 | None | 93 μm | No | This Invention |
| 2 | No. 4 | No. 9 | None | 69 μm | No | This Invention |
| 3 | No. 5 | No. 7 | None | 75 μm | No | This Invention |
| 4 | No. 6 | No. 7 | None | 81 μm | No | This Invention |
| 5 | No. 4 | No. 9 | None | 38 μm | No | This Invention |
| 6 | No. 5 | No. 9 | None | 44 μm | No | This Invention |
| 7 | No. 1 | No. 8 | None | 104 μm | No | This Invention |
| 8 | No. 2 | No. 8 | None | 122 μm | No | This Invention |
| 9 | No. 10 | Oil[1] | Galling | 288 μm | Yes[2] | Conventional |

TABLE 17-continued

Hot rolling test on JIS SUS 304 stainless steel (about 1800 tons)

| Test No. | Lubricant number applied to Nozzles 1 | 2 | Galling of work rolls in edge portions | Maximum depth of roll wear | Mill trouble | Remarks |
|---|---|---|---|---|---|---|
| 10 | No. 11 | Oil[1] | Galling | 311 μm | No | Conventional |

[1]Commercially available hot-rolling oil as indicated in Table 1.
[2]Failure of smooth insertion of the steel into the roll gap and slippage of the steel during hot rolling.

As is apparent from the results shown in Tables 16 and 17, the work rolls could be prevented from galling even in the edge portions, and surface roughening and banding of the rolls in those portions could be avoided in those runs according to this invention. Furthermore, the roll wear could be significantly reduced and rolling troubles such as slippage did not occur in these runs.

It will be appreciated by those skilled in the art that numerous variations and modifications may be made to the invention as described above with respect to specific embodiments without departing from the spirit or scope of the invention as broadly described.

What is claimed is:

1. A lubricating composition for use in hot rolling of steels, which comprises a base lubricating oil selected from the group consisting of synthetic lubricating oil, rapeseed oil, lard oil, higher fatty acids and higher fatty acid esters and from about 20% to about 70% by weight, based on the total weight of the composition, of an overbased metal sulfonate having a base number of at least about 40 mg-KOH/g in which the metal is one or more alkaline earth metals.

2. The lubricating composition of claim 1, wherein the metal is one or more alkaline earth metals selected from Ca, Mg, and Ba.

3. The lubricating composition of claim 2, wherein the metal is Ca.

4. The lubricating composition of claim 1, wherein the overbased metal sulfonate has a base number of at least about 200 mg-KOH/g.

5. The lubricating composition of claim 4, wherein the overbased metal sulfonate has a base number in the range of from about 200 to about 500 mg-KOH/g.

6. The lubricating composition of claim 1, comprising from about 30% to about 60% by weight of the overbased metal sulfonate.

7. A lubrication method comprising applying a lubricating composition comprised of a base lubricating oil and from about 20% to about 70% by weight, based on the total weight of the composition, of an overbased metal sulfonate having a base number of at least about 40 mg-KOH/g in which the metal is one or more alkaline earth metals to at least one pair of work rolls in a rolling mill during hot rolling of a steel.

8. The lubrication method of claim 7, wherein the lubricating composition is applied directly to the work rolls.

9. The lubrication method of claim 7, wherein the lubricating composition is applied to the work rolls through their backup rolls.

10. The lubrication method of claim 7, wherein the steel to be hot rolled is also lubricated with the lubricating composition immediately before it is subjected to hot rolling.

11. The lubrication method of claim 10, wherein the lubricating composition is applied to the steel through a pair of pinch rolls located immediately before the work rolls.

12. The lubrication of claim 7, wherein the steel is selected from carbon steels and stainless steel.

13. The lubrication method of claim 7, wherein the steel is high-Cr stainless steel.

14. A lubrication method for lubricating work rolls in a rolling mill during hot rolling of steel comprising applying a first lubricating composition to both edge portions of each work roll and applying a second lubricating composition to a central portion of each work roll wherein the first and second lubricating compositions each comprise a base lubricating oil and from about 20% to about 70% by weight, based on the total weight of the composition, of an overbased metal sulfonate having a base number of at least about 40 mg-KOH/g in which the metal is one or more alkaline earth metals and wherein the base number of the overbased metal sulfonate of the first lubricating composition is higher than the base number of the overbased metal sulfonate of the second lubricating composition.

15. The lubrication method of claim 14, wherein the base number of the overbased metal sulfonate is at least about 200 mg-KOH in the first lubricating composition and between about 40 and about 200 mg-KOH in the second lubricating composition.

* * * * *